United States Patent [19]

Cortorillo

[11] 4,367,433

[45] Jan. 4, 1983

[54] SELF BALLASTED LAMP FOR AUTOMOTIVE, AIRCRAFT RUNWAY, ETC. LIGHTING

[75] Inventor: Salvatore F. Cortorillo, Parsippany, N.J.

[73] Assignee: Edison International, Inc., Rolling Meadows, Ill.

[21] Appl. No.: 180,696

[22] Filed: Aug. 25, 1980

[51] Int. Cl.[3] ..... H01J 7/44

[52] U.S. Cl. ..... 315/49; 313/220

[58] Field of Search ..... 315/49; 313/220; 29/25.16

[56] References Cited

U.S. PATENT DOCUMENTS 985,486 3/1911 Wohlauer ..... 315/49

2,208,998 7/1940 Mey ..... 315/49

3,048,741 8/1962 Thouret ..... 315/49

3,551,736 12/1970 Doehner ..... 313/220

3,693,007 9/1972 Kerkes ..... 313/220

3,923,189 12/1975 Faulkner ..... 313/220

4,268,780 5/1981 Roche et al. ..... 315/49

*Primary Examiner*—Harold A. Dixon

*Attorney, Agent, or Firm*—Ronald J. LaPorte; Jon C. Gealow; Charles W. MacKinnon

[57] ABSTRACT

A tungsten filament lamp incorporates arc discharge electrodes for an arc discharge in a gas fill enclosed in the lamp envelope. The tungsten filament is utilized as a ballast resistance for the arc discharge. A method for mounting the filament and electrodes in an embodiment according to the invention is shown.

3 Claims, 13 Drawing Figures

SELF BALLASTED LAMP FOR AUTOMOTIVE, AIRCRAFT RUNWAY, ETC. LIGHTING

BACKGROUND OF THE INVENTION

The invention relates to lamps adapted for use as headlamps on automobiles, and for other uses where a tungsten incandescent lamp has been conventionally used but where the intensity and color rendition of an arc lamp would also be desirable.

Several lamps in which an arc discharge has been combined with an incandescent filament have been developed. A typical lamp consisted of a mercury arc discharge between tungsten electrodes at the terminals of a tungsten filament. Such a mercury arc lamp has been used particularly in the home as sunlamps for obtaining skin tans indoors.

One great disadvantage of such lamps is that the arc discharge in vapor lamps has a negative resistance characteristic. This means simply that a higher current in the arc reduces the resistance of the arc. Without some sort of stabilization a runaway condition occurs in which the higher current lowers the resistance of the arc which further increases the current until the electrodes themselves are destroyed. To overcome this, the arc lamps normally require an external ballast resistance to keep the current within acceptable levels so as not to destroy the lamp. Because of the energy which must be dissipated in the ballast resistor, the efficiency of the lamp circuit is lowered.

SUMMARY OF THE INVENTION

In the embodiments described below, an arc discharge is combined with a tungsten filament which is used as the ballast resistance for the arc discharge in the lamp. Both sources in one unit combine to provide a lamp which produces enhanced light output by using known gas fills in conjunction with the arc. Best results are achieved by using a known gas fill capable of both improving the color rendition of the light output and for increasing the output intensity. The lamp is self-ballasted through the tungsten filament and thereby provides a highly compact unit requiring no external ballast. The arc discharge may be initiated by a spark from a capacitor or a capacitor in conjunction with a step-up transformer, but in a preferred embodiment the configuration of the electrodes and filament are such that the arc discharge is self-initiating upon application of power to the lamp.

BRIEF DESCRIPTION OF THE DRAWINGS

FIG. 1 shows a lamp according to the invention generally at 10. A tungsten filament 12 is supported on supports such as molybdenum supports 30*a*, 30*b* mounted on a glass preform 22 of the type well known in the art. Two electrodes, one of pure tungsten and the other of material such as 2% thoriated tungsten 14, 16 are also supported by the preform 22. One electrode 14 is electrically connected to one end of filament 12. The other electrode 16 is mounted on a support such as the molybdenum support 30*c* sufficiently close in conventional manner to the electrode 14 so that a discharge arc may be struck between the two electrodes. The supports 30*a* and 30*c* are electrically conducting so that a series circuit will be defined by support 30*a*, filament 12, an electrical discharge arc between electrodes 14 and 16, and the support 30*c* whenever electrical potential above a predetermined voltage is connected between 30*a* and 30*c*.

Figure 1:
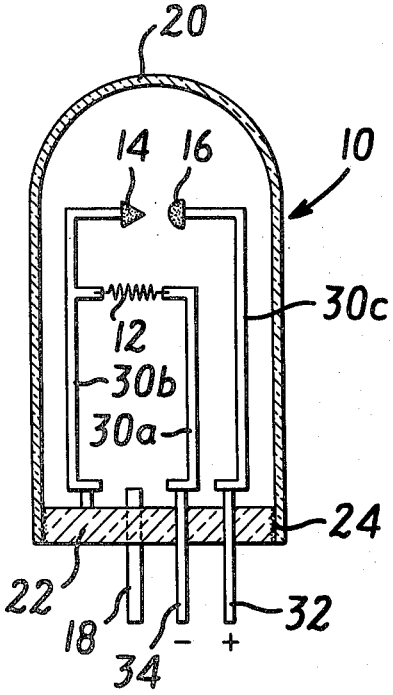
FIG. 1 is a view of one embodiment of the lamp according to the invention.

The filament and discharge arc assembly are enclosed in an alumino-silicate glass envelope 20 which is first evacuated or flushed and filled with, for example, organic halogens or metal halide compounds in a rare gas in order to provide enhanced light out-put from the discharge arc. The gas fills may be chosen from such fills as pure hydrogen bromide, methyl iodide in krypton or argon, fluoride compounds such as nitrgen fluoride in krypton or argon, and methyl bromide in krypton or argon. Alternatively, the gas fill may be an inert gas such as nitrogen, krypton, argon, etc.

As is well-known in the art, other types of glass materials for the glass envelope may be used. The use of quartz for the lamp envelope is also contemplated. The supports 30*a*, 30*b*, and 30*c* are sealed into a preform 22 which is sealed at 24 of the glass envelope 20 to form a hermetic seal in a manner well known in the art.

A molybdenum tube 18 is mounted in the preform 22 and extends through the press 24 to provide a means for exhausting and filling the envelope. After the envelope is filled the molybdenum tube 18 is cold pressed in an area external to the envelope and then cut by known welding or laser techniques.

It is not necessary to use a molybdenum tube. The tube 18, preform 22 and envelope 20 may all be made of the same material such as alumino-silicate glass or of materials with matching expansion characteristics. In such case, after the envelope is exhausted, closed and filled with gas such as krypton gas, the gas within the envelope may be condensed by freezing the fill gas to liquid nitrogen temperatures and thereafter the tube is sealed using conventional techniques while the fill gas remains frozen. While not necessary, the gas within the envelope may be condensed by freezing the gas fill when using a molybdenum tube 18 but this is of no particular advantage.

Depending upon anticipated conditions, the electrodes 14, 16 for the discharge lamp portion are optionally made of either pure tungsten, 2%-thoriated-tungsten rod or rare earth or alkali emission materials such as barium, strontium or calcium carbonates. For best results the rare earth or alkali is embedded in a porous tungsten rod. The use of these materials is a function of the additives and other gases introduced into the envelope as well as the operational parameters such as lifetime output, expense, etc. Given the desired parameters, the choice of material is easily made by a person skilled in this art.

The arc discharge between electrodes 14 and 16 in FIG. 1 cannot be initiated unless there is some form of initial ionization in the gap between the two electrodes. This preliminary ionization can be initiated by a high voltage pulse from a capacitor (not shown) creating a spark between the electrodes 14, 16. However, the most efficient means for initiating the arc is achieved by placing the electrode 16 in close proximity to the filament 12 so that pre-ionization of the gas in the gap due to the electrical potential between 12 and 16 is sufficient to strike the arc between electrodes 14 and 16.

For operation, the external pins 32 and 34 of the lamp are connected to a source of DC power (not shown) of a range from approximately 12 volts to approximately 28 volts. The relationship of the filament 12 and the electrodes 14 and 16 is such that upon connection to the DC power source, a preionization of the gas fill in the region of the gap between the electrodes takes place. When sufficient preionization has occurred the arc discharge is initiated. The arc discharge completes an electrical circuit in which the filament 12 forms a series element in relation to the arc.

An alternative method of initiating the arc is by use of a capacitative discharge from a capacitor (not shown) through the circuit to create a preionization pulse between the electrodes. A pulsed output through a step-up transformer to a starting electrode may also be utilized particularly for embodiments having longer gap length.

The resistance of the tungsten filament 12 in series with the arc discharge between electrodes 14 and 16 serves to limit the current to acceptable levels despite the negative resistance characteristic of the arc discharge.

The additives in the Krypton gas fill serves to enhance the light output of the arc discharge in a manner that is well known in the art. Other known gas fills may also be selected to obtain desired color or light output enhancing characteristics.

Figure 2:
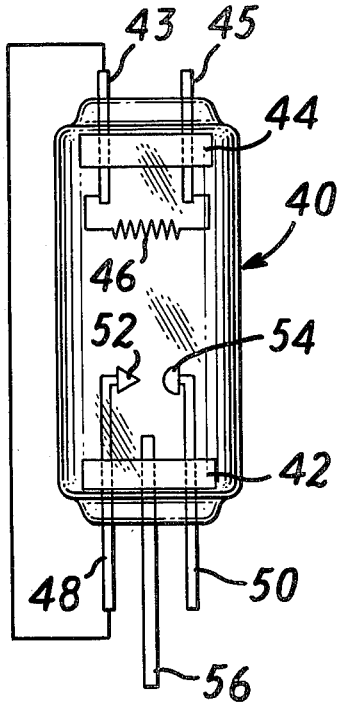
FIG. 2 is an alternative embodiment in which the arc and the tungsten filament are enclosed on separate ends of the lamp envelope.

Referring now to FIG. 2, a glass envelope 40 of desired length encloses a preform 42 at one end and a preform 44 at the opposite end.

Two molybdenum support pins, 43 and 45 to which a tungsten filament 46 is attached are mounted in preform 44. Support pins 48 and 50 to which electrodes 52 and 54, respectively are affixed are mounted in preform 42. A molybdenum fill tube 56 is also affixed in preform 42.

Each end of the glass tube 40 has a preform hermetically sealed to the glass envelope 40 as is well known in the art. As has been described in conjunction with FIG. 1 the envelope is exhausted through tube 56 and a gaseous mixture of additives, for example, and not as a limitation methyl iodide in Krypton is introduced into the glass envelope through the tube. The molybdenum tube 56 is then sealed and cut by conventional techniques.

Pins 43 and 48 are externally connected to provide a series electrical circuit when the proper potential is placed upon pins 43 and 48. Pins 43, 45, 48 and 50 may be made of pure tungsten or they may be molybdenum to which a pure tungsten filament 46 is attached. The electrodes may optionally be an emission alkali embedded in porous tungsten rod.

Figure 3:
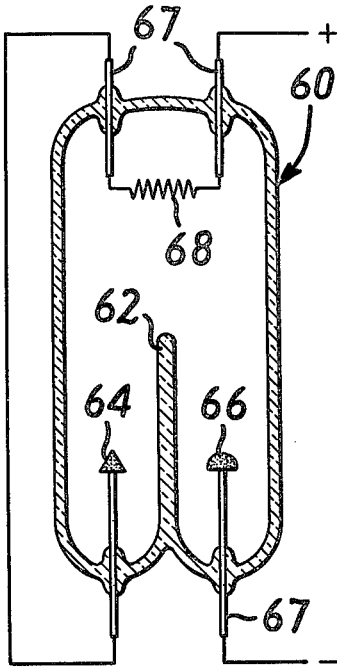
FIG. 3 is a modification of the invention in which a projecting rib of the envelope is incorporated as a barrier between the electrodes in order to increase the length of the discharge path.

FIG. 3 is an alternative embodiment of the invention. A glass envelope 60 has a rib 62 projecting into the interior of the envelope to partially separate the space between the two electrodes 64 and 66. The rib 62 is a barrier that interrupts the direct path of the arc between the two electrodes in order that the length of the arc may be increased. For the arc to be struck in this embodiment, there must be an external starting means for example capacitor and step up transformer (not shown) to create the required ionization path between the electrodes.

In this embodiment the pins of FIG. 2 are replaced by tungsten wire 67 which is sealed into the envelope to support filament 68. A selected gas fill is introduced into the envelope after evacuation and the glass envelope is sealed using conventional techniques well known in the art.

Figure 4A:
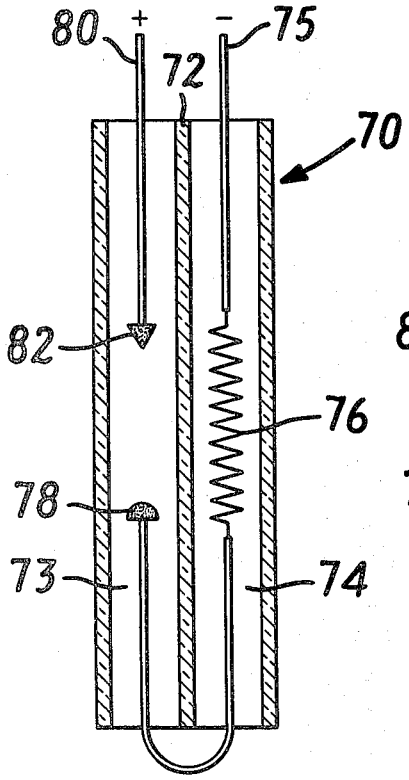
FIG. 4*a* is a side view of single-ended self-ballasted lamp according to the invention which is adapted for press sealing at each end.

FIG. 4*a* is a self-ballasted lamp according to the invention housed in a linear tube wherein the leads are disposed at one end of the tube for press sealing at that point. A double bored quartz or glass tube 70 having a quartz or glass rib 72 is cut to the desired length. The rib 72 divides the lamp envelope into two compartments 73 and 74. A tungsten wire 75 having a filament 76 is shaped in the form of J with a 2% thoriated tungsten electrode 78 attached to the small end of the J, is inserted into the double bored tube compartment 74 so that the filament is centered in one side of the double bore. The electrode 78 in this configuration is in the opposing bore compartment 73 at a position corresponding to one end of the tungsten filament. A second tungsten wire 80 carrying a second tungsten electrode 82 is inserted at the other end of the bore having electrode 78 and is positioned so that an arc may be struck between the two electrodes.

Figure 4B:
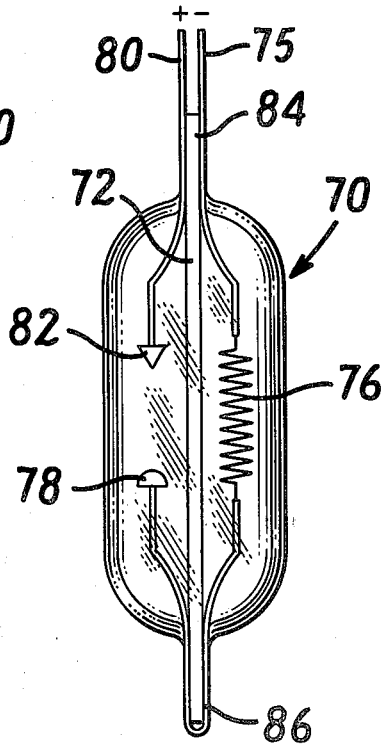
FIG. 4*b* is a side view of the single ended self-ballasted lamp after sealing.
Figure 4C:
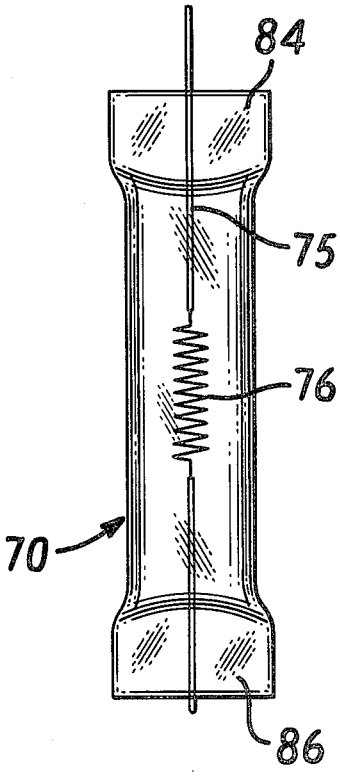
FIG. 4*c* is a front view of the lamp of FIG. 4*b;*

As shown in FIGS. 4*b* and 4*c* both ends of the quartz or glass tube are pressed as at 84 and 86 to seal the electrodes and filament into their respective areas of the envelope 70. In this configuration, the filament and the arc may have the same or different proper gas fills for the purpose of enhancing color rendition and light output. In the case of the discharge arc additives such as Mercury may be added to Krypton and a conventional halogen gas fill may be used for the tungsten filament in the opposed bore.

Figure 5:
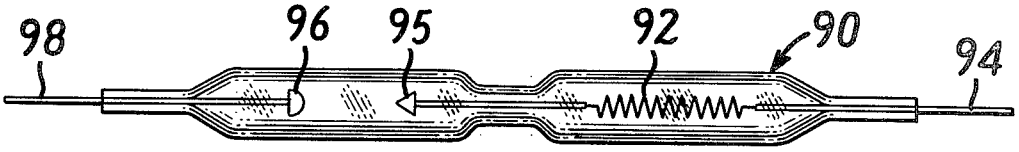
FIG. 5 is a linear self-ballasted lamp according to the invention.

FIG. 5 shows a glass tube 90 of single bore construction in which the tungsten filament 92 is disposed in one area of the tube on a suitable lead 94 while the discharge arc electrodes 94 and 96 on a second lead 98 are disposed in a separate section of the linear tube. The tube necks down at a point between the filament and the desirable arc and may either be sealed at this point or left open to allow a mixture of the gases in the discharge arc section with that of the filament section. The tube is press sealed at both ends in the conventional manner with the tungsten wire leads passing through the press. Alternatively the elements may be mounted molybdenum foil seals (not shown) for passing through the press.

Figure 6:
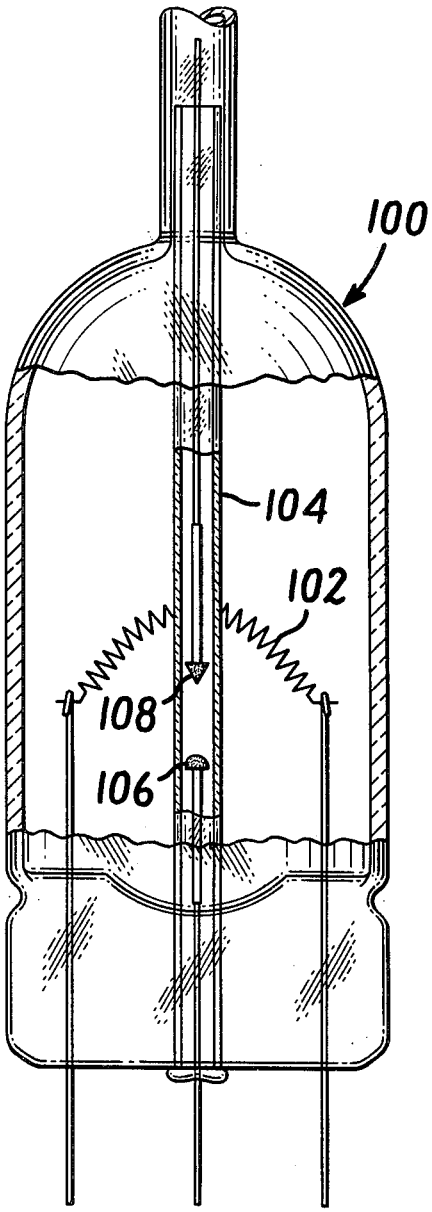
FIG. 6 is a prior art tungsten lamp in which a tube containing the arc discharge is fitted.
Figure 7A:
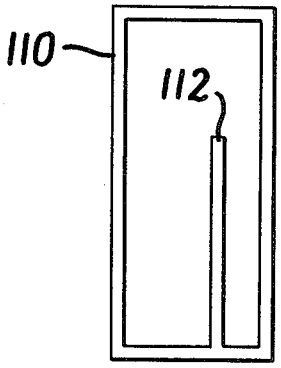
FIGS. 7*a* through 7*d* illustrates a method for mounting the filament and electrodes of one embodiment of the lamp according to the invention.
Figure 7B:
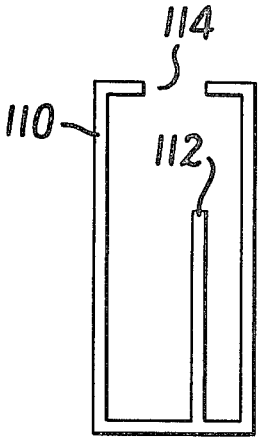
Figure 7C:
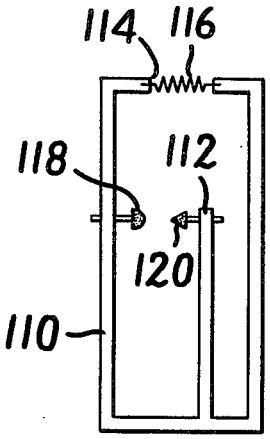
Figure 7D:
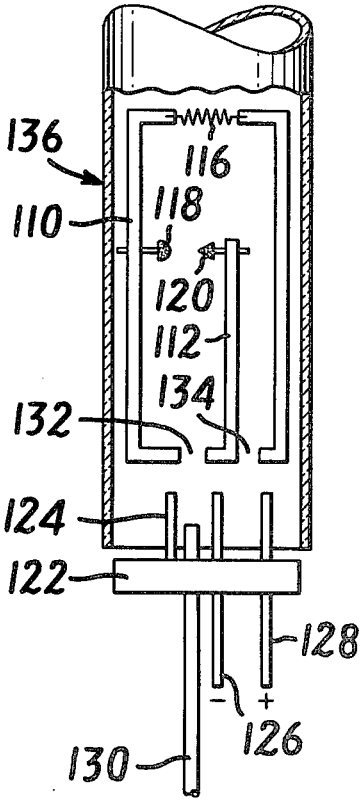

Referring now to FIG. 6, a tungsten lamp envelope 100 having one or two filaments 102 is shown. A glass tube 104 containing the electrodes 106 and 108 and support leads are disposed in the lamp envelope so that the arc discharge path is approximately in the location of the tungsten filament. The filament leads, electrodes, and tube 104 are press sealed within the lamp envelope in conventional manner. The top of the lamp envelope and tube 104 are left open for the purpose of exhausting and filling the tube and envelope containing the discharge arc electrodes and filament. As described above, the tube 104 may be exhausted and filled with the desired additives to the Krypton gas or other fills to enhance the light output, luminous efficiency and color rendition. The other envelope 100 may be simultaneously filled with halogen gas for halogen cycle operation of the tungsten filament.

The lamp envelope may also house the discharge electrodes so that without the filaments the lamp will act as a discharge source only. The outer jacket may be filled to either high or low pressures to protect the discharge source.

In FIGS. *7a* through *7d,* a method for mounting the electrodes and tungsten filament is shown. The advantage of this method is that the electrodes of the arc discharge are maintained in proper registration and are kept in predetermined relationship with the filament so that the required preionization of the gap between the electrodes is achieved when power is applied to the lamp of FIG. 1.

FIG. *7a* shows a blank which has been stamped from a sheet of molybdenum. The stamped blank 110 is shaped as a rectangular frame having an open interior with an arm 112 of the frame projecting into the interior of the frame. As shown in FIG. *7b,* the top of the frame is subsequently cut by conventional means so that a gap 114, is provided for mounting a tungsten filament.

A tungsten filament 116 is then attached to each end of the frame to bridge the gap 114 cut from the frame 110. Electrode 118 is mounted at an intermediate point one one side of the molybdenum blank. A second electrode 120 is mounted on the projecting arm 112 so that it is opposite the electrode 118.

The electrodes 118 and 120 are optionally pure tungsten, 2% thoriated tungsten rod or alkali rare earth material imbedded in porous tungsten rod as described in conjunction with FIG. 1. As shown in FIG. *7c,* the anode electrode 118 is slightly larger than that of the electrode 120 operating as cathode.

Turning now to FIG. *7d,* a schematic representation of the lamp prior to final assembly is shown. A preform 122 has mounted thereon three molybdenum pins 124, 126 and 128 respectively. The molybdenum pin 124 is not carried through the preform and serves only as a mounting point. The pins 126 and 128 are of sufficient length to carry through the glass preform for the purpose of connecting the lamp to a power source. A glass or molybdenum exhaust tube 130 is also mounted in the preform. The use of this tube is described further below.

The assembly 110 of FIG. *7c* is welded by conventional techniques to the pins 124, 126 and 128. The advantage of this is that the assembly can be moved either vertically or laterally for focusing if required by the particular construction of the lamp. After the assembly is mounted to the preform, two additional cuts 132 and 134 are performed on the frame 110.

A lamp envelope 136 of desired dimension covers the entire assembly and is sealed in a conventional manner to the preform 122 with the exhaust tube and the ends of the pins 126 and 128 projecting through the preform. The envelope is then exhausted and filled through the molybdenum exhaust tube 130 which is pressed to form a cold weld and then cut off as desired.

Figure 8:
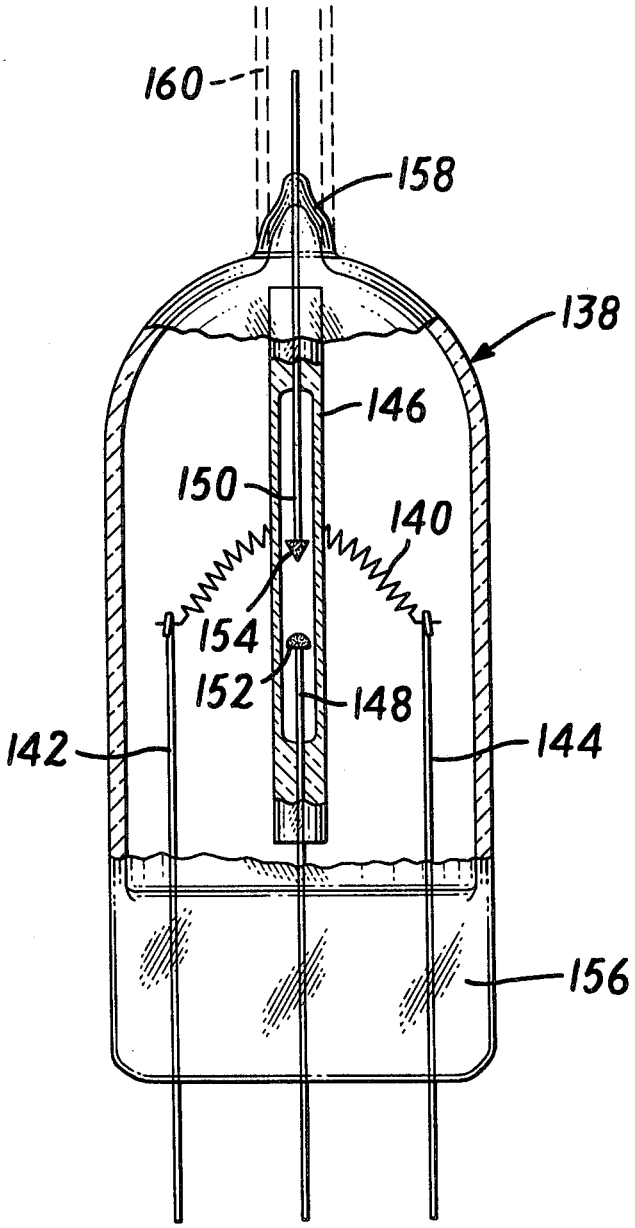
FIG. 8 is a tungsten filament lamp similar to that of FIG. 6 wherein the arc electrodes are maintained in an atmosphere separate from that surrounding the tungsten filament.

FIG. 8 shows a tungsten lamp envelope 138 having a filament 140 supported therein by filament support leads 142 and 144. An alumino-silicate glass or quartz arc discharge tube 146, filled with a light-enhancing gas fill, is sealed at each end with arc-electrode leads 148 and 150 carried through the seals to support arc electrodes 152 and 154 in the bore thereof. The filament support leads 142 and 144 and one (148) of the leads of the arc electrodes are sealed into the base of the lamp by a press seal 156. The arc electrode lead 150 at the other end of the glass tube 146 is supported and sealed into the lamp envelope 138 at the exhaust tube tip-off 158 at the top of the tungsten lamp envelope. The tube 146 having the arc electrodes therein is thus maintained completely separate from the atmosphere in the surrounding lamp envelope and is supported within the lamp by the electrode leads.

The arc discharge tube 146 with the arc electrodes 152 and 154 therein can be manufactured as a separate entity. That is, the arc electrodes 152 and 154 can be positioned within the bore of a suitable glass tube, the tube exhausted or flushed, refilled with light-enhancing gas, such as an organic halogen or other halogen compounds in a rare gas, or simply with an inert gas such as nitrogen, argon, krypton, etc. and sealed off at each end in a conventional manner.

The completed arc discharge tube is then positioned in the envelope 138 with the arc electrode lead 150 passing into the exhaust tube 160 shown in dotted lines in FIG. 8. The arc electrode 148 is positioned and held along with the other filament support leads 142 and 144 for the formation of a press seal 156. The arc discharge path between the two electrodes 152 and 154 is maintained approximately in the location of the tungsten filament 140.

The top of the lamp envelope 138 has an exhaust tube 160 which is open for exhausting and filling. The lamp envelope 138 is exhausted or flushed and then filled with either a standard inert atmosphere or a gas having conventional additives for halogen cycle operation. Finally the exhaust tube 160 is tipped-off in conventional manner 50 that the arc-electrode lead 150 is supported by and sealed in the tip-off 158 at the top of the lamp.

It will be understood that it is intended to cover all changes and modifications of the preferred embodiments of the invention herein chosen for the purpose of illustration which do not constitute departures from the spirit and scope of the invention.

What is claimed is:

1. A self ballasted, tungsten filament, electrode arc lamp, including in combination:

a hermetically sealed, gas filled lamp envelope;

a filament mounted within said envelope;

first and second predeterminedly spaced electrodes mounted within said envelope;

means for electrically connecting one end of said filament to the first of said first and second spaced electrodes;

means for connecting an electric potential of a first polarity to the second end of said filament and an electric potential of the opposite polarity to the second one of said first and second space electrodes;

said filament being predeterminedly positioned within said envelope in sufficiently close proximity to said second one of said first and second spaced electrodes to induce ionization of said gas in said envelope in response to the application of said first and opposite polarity electric potential to said second end of said filament and to said second one of said electrodes, respectively, for striking an arc between said first and second electrodes, thereby to complete an electrical series circuit through said filament and arc.

2. A self ballasted, tungsten filament electrode arc lamp including in combination: a hermetically sealed, gas filled lamp envelope; a filament mounted within said envelope; first and second predeterminedly spaced electrodes mounted within said envelope; means for electrically connecting one end of said filament to one of said first and said second spaced electrodes; means for connecting electric potential to the second end of said filament and to the second one of said first and second spaced electrodes; said filament and said first and second electrodes forming resistive elements in a series electrical circuit with an arc established between said first and second electrodes; and electrically conductive frame means disposed within said lamp envelope, said filament and said first and second electrodes being mounted on said frame means at predetermined locations, said frame means supporting said filament and first and second electrodes within said envelope, wherein said frame means is rectangular in shape having first and second opposite short sides and first and second opposite long sides, a portion of a first of said short side of said rectangular frame being removed to define opposing arm portions, said filament being mounted between and attached to said arm portions and a projection extending from said second side of said frame toward said filament, one of said electrodes being mounted at the free end of said projection, the other of said electrodes being mounted on one of said long sides of said frame opposite to said first one of said electrodes, to define a gap therebetween, predetermined portions of said second short side of said rectangular frame being removed between said projection and said opposite long side of said frame, respectively, thereby to define three support legs for said filament and electrodes.

3. The lamp of claim 2 further including a preform sealed into said lamp envelope at one end thereof, and conductive pin means extending through said preform from the exterior to the interior of said lamp envelope, said three support legs being mechanically and electrically connected to three of said pin means, respectively.

* * * * *